US008677988B2

(12) United States Patent
Jin

(10) Patent No.: US 8,677,988 B2
(45) Date of Patent: Mar. 25, 2014

(54) ECCENTRIC TELESCOPIC PORTABLE OUTDOOR HEATER

(76) Inventor: Weidong Jin, Shenzhen (CN)

( * ) Notice: Subject to any disclaimer, the term of this patent is extended or adjusted under 35 U.S.C. 154(b) by 1106 days.

(21) Appl. No.: 12/449,126

(22) PCT Filed: May 24, 2007

(86) PCT No.: PCT/CN2007/001684

§ 371 (c)(1),
(2), (4) Date: Jul. 22, 2009

(87) PCT Pub. No.: WO2008/092315

PCT Pub. Date: Aug. 7, 2008

(65) Prior Publication Data

US 2009/0308382 A1 Dec. 17, 2009

(30) Foreign Application Priority Data

Jan. 23, 2007 (CN) ..... 2007 2 0001285 U

(51) Int. Cl.
*F24C 3/04* (2006.01)

(52) U.S. Cl.
USPC ..... 126/92 AC; 126/91 R; 126/92 B

(58) Field of Classification Search
USPC ..... 126/92 AC, 58, 92 B, 41 R, 25 R, 92 R, 126/213, 258, 276, 91 R; 431/110, 344; 362/92, 93, 179, 266, 427
See application file for complete search history.

(56) References Cited

U.S. PATENT DOCUMENTS

| | | | | |
|---|---|---|---|---|
| 6,336,450 | B1 * | 1/2002 | Collet | 126/92 B |
| 6,499,480 | B2 * | 12/2002 | Ashton et al. | 126/92 B |
| 2004/0035408 | A1 * | 2/2004 | Szentkuti | 126/41 R |
| 2004/0177843 | A1 * | 9/2004 | Bernini et al. | 126/92 AC |
| 2006/0198084 | A1 * | 9/2006 | Hall et al. | 361/600 |
| 2007/0101983 | A1 * | 5/2007 | Yao | 126/92 B |

* cited by examiner

*Primary Examiner* — Kenneth Rinehart
*Assistant Examiner* — Bao D Nguyen
(74) *Attorney, Agent, or Firm* — Raymond Y. Chan; David and Raymond Patent Firm

(57) ABSTRACT

An eccentric telescopic portable outdoor heater includes a burner assembly, a base, and a connecting assembly provided between the burner assembly and the base. The connecting assembly is an arched telescopic curving-arm assembly adjusting the height of the burner assembly, which has a lower curving-arm, an upper curving-arm inserted into the lower curving arm, a lock device and a locating device. The base is a subassembly convenient for a gas bottle to be put in or taken out, which includes a supporting assembly, a gas bottle cover assembly, a door and sliding track assembly, a gas bottle cover assembly, a door and sliding track assembly. The base, the connecting assembly, and the burner assembly form the eccentric telescopic portable outdoor heater with smooth arched configuration.

11 Claims, 9 Drawing Sheets

ECCENTRIC TELESCOPIC PORTABLE OUTDOOR HEATER

BACKGROUND OF THE PRESENT INVENTION

1. Field of Invention

The present invention relates to an outdoor heater, and more particularly to an outdoor heater which is capable of providing heat for people to warm themselves by transforming gas or natural gas into heat energy.

2. Description of Related Arts

In winter, most areas in China are relatively cold. In order to keep people warm when they work outdoors, they usually burn firewood, charcoal or coal as a fuel to make a bonfire of fuel. However, it will cause environmental pollution and it is inconvenient for people as well. China Patent, 00207130, disclosed a natural gas outdoor heater which comprises a burner, a two-time heat absorbing apparatus, a gas stove, a heating tube, a windproof casing, and a temperature control, wherein the fuel passes through the double-layered heating tube to solve the problem of environmental pollution. However, such outdoor heater requires water as a heating media and is inconvenient for transport.

China Patent 02225862.0 disclosed an outdoor heater including an umbrella shaped reflector, a burner, a control apparatus, a supporting base, wherein the outdoor heat is convenient for people to transport. Accordingly, the umbrella shaped reflector comprises a central retention cover, a plurality of umbrella shaped panels, a central panel stacking together, wherein the number of the umbrella shaped panel can be from 3 to 8. Such outdoor heater is simple in structure and is easy for the user to transport and assemble. The manufacturer is able to disassemble the umbrella shaped reflector to minimize the packaging space of the outdoor heater for transportation. However, the combustion control of such outdoor heater still has some problems.

China Patent 00239575.4 disclosed an outdoor heater including a reflective umbrella, a burning cover, an outer seat cover, a seat valve, a valve body, a supporting member, a cover, a body, and a base. The reflective umbrella comprises a plurality of umbrella panels coupling with each other. The body comprises a body cover and a plurality of body panels coupling with the body cover, wherein some of the body panels are coupled with a connecting panel and are embedded under the base. The advantages of such outdoor heater are that the structure is simple and is easy to assemble. The user is able to conveniently transport outdoors and the outdoor heater is safe to use. Since the outdoor heater can be disassembled to form a compact size, it can save the packaging space during transportation and can minimize its transportation cost. However, such outdoor heater has the same above mentioned problem of its combustion control. In particularly, the heating range of the outdoor umbrella cannot be adjusted and its appearance and structure needs to be improved.

Therefore, China Patent Application, 200520005035.0, which is the same inventor of the present invention, discloses an infrared remote control outdoor heater comprising a burner assembly, a hollow supporting post, and a base. The burner assembly comprises an air-mixing chamber provided at the upper portion of the supporting post, an infrared casing positioned below the air-mixing chamber, a reflector positioned below the infrared casing, a heat-isolating panel positioned below the reflector, a burner positioned below the heat-isolating panel, and a combination control apparatus positioned below the burner. The burner comprises a burner head, a main burner, a nozzle, an electrical valve assembly, fuel inlet pipe, and a pressure-reducing valve assembly. The combination control apparatus comprises a control circuit, a battery casing, a thermocouple which is located at the main burner and is electrically coupled with an electromagnetic valve assembly and an electric motor of the electrical valve assembly. The combination control apparatus further comprises an oxygen detector, an ignition tip, a flame detector located around a flame hole of the burner, a switch provided at a sidewall of the air-mixing chamber, an infrared receiver, and a toppling switch. During operation of the outdoor heater, a gas bottle is operatively connected to the outdoor heater such that when the battery disposed in the battery casing is activated, the main burner will ignite the fuel supplying from the gas bottle at the chamber, so as to provide a remote controlled outdoor heater. Accordingly, the outdoor heater overcomes the shortcomings of the above mentioned problems. However, there is always an improvement to enhance the use of the outdoor heater, especially the installation of the gas bottle, the height-adjustment of the burner, and the heat distribution of the burner.

Therefore, the inventor proposes the invention as the improvement.

SUMMARY OF THE PRESENT INVENTION

A main object of the present invention is to provide an eccentric telescopic portable outdoor heater to overcome the shortcoming of the present technology. The outdoor heater has better control of the heat radiation range. Moreover, it is convenient for gas storage. The structure and the appearance of the outdoor heater are improved to meet the user's requirement.

Accordingly, in order to accomplish the above objects, the present invention provides an outdoor heater which comprises a burner assembly, a supporting base, and a connecting assembly provided between the burner assembly and the supporting base. The connecting assembly is an arched telescopic curving-arm assembly for the burner assembly to selectively adjust a height of the burner assembly with respect to the supporting base. The supporting base further comprises an easy fuel installation structure for receiving a fuel container, i.e. a gas bottle, in a cavity of the supporting base such that the fuel container can be replaceably held in the supporting base to operatively link with the burner assembly. The supporting base, the connecting assembly, and the burner assembly form an eccentric retractable and portable structure that the outdoor heater has a smooth arched configuration.

The burner assembly comprises an arc-shaped supporting arm having a retractable ability, wherein a lower portion of the supporting arm is coupled with an upper portion of the connecting assembly via a screw while an upper portion of the supporting arm is coupled with a reflection casing with a corresponding arc-shape via two screws, and a supporter. The burner is coupled with the supporter via a screw. The supporter further comprises a rotatable knob provided at the lower portion thereof to operatively couple with a valve of the burner, so as to operate the valve in a controllable manner. The supporter further comprises an igniter, a gas channel, and a pressure reducing valve assembly respectively provided at the lower portion of the supporter, wherein the gas channel and the pressure reducing valve assembly are respectively extended through the connecting assembly to the supporting base for operatively connecting to the fuel container.

The easy fuel installation structure of the supporting base comprises a supporting assembly and a gas bottle cover assembly having a shape and size corresponding to the supporting assembly for the supporting assembly enclosing within the gas bottle cover assembly. The supporting base further comprises a door and sliding track assembly coupled between the gas bottle cover assembly and the supporting assembly to form an enclosed structure of the supporting base.

The burner comprises an infrared casing and an injection tube operatively coupling thereto, wherein a burner supporter is coupled with the injection tube. A screw hole is formed at the burner supporter to couple with the corresponding screw at the supporter such that the screw is engaged with the screw hole to couple the burner supporter with the supporter.

The easy fuel installation structure of the supporting base further comprises a guiding groove provided at the upper portion of the supporting assembly and is coupled with a supporting panel.

The gas bottle cover assembly of the supporting base further comprises a casing body, an enclosure detachably coupling with the casing body via a screw, a lower arm protection ring provided at an upper portion of the casing body, and four standing legs provided at a bottom side of the casing body at corners thereof respectively.

The door and sliding track assembly of the supporting base comprises a supporting rack, two sliding trackers spacedly provided at an outer edge of the supporting rack, and two supporter plates coupling with the sliding trackers respectively, wherein an inner edge of the supporting rack has a curved shape. Two wheel supporting panels are respectively coupled with two side edges of the supporting rack via screws, wherein two wheel shafts are extended from the wheel supporting panels. Two wheel assemblies are operatively coupled at the wheel shafts respectively. A door assembly is coupled at the inner curved edge of the supporting rack, wherein a left pulling arm and a right pulling arm are respectively extended from the left and right sides of the door assembly to the supporting rack such that each of the pulling arms has two ends coupling with the door assembly and the supporting rack via two screws.

The connecting assembly comprises a tubular lower curving-arm having an arc-shape, a tubular upper curving-arm having an arc-shape slidably coupling with the lower arm, a lock device provided between the lower and upper curving-arms for locking the lower and upper curving-arms in position, and a locating device, wherein a tubular connector is coupled at a lower portion of the lower curving-arm via a screw. A lower portion of the tubular connector is coupled with the supporting panel of the supporting assembly of the supporting base via a screw.

The lock device comprises an inner tubular locker affixed to an upper portion of the lower curving-arm via rivets, and an outer tubular locker rotatably coupling with the inner tubular locker.

The locating device is provided between the lower and upper curving-arms, wherein the locating device comprises a head stopper provided at a lower end of the upper curving-arm. The locating device further comprises a retainer having a through slot formed thereon, and a flexible element, wherein the retainer is extended through retention holes of the lower and upper curving-arms. The flexible element is supported within the upper curving-arm, wherein one end of the flexible element is affixed to the through slot of the retainer while another opposed end of the flexible element as a free end thereof is biased against an inner wall of the upper curving-arm.

The tubular locker has a hollow cylindrical shape and has an inner diameter matching with an outer diameter of each of the lower and upper curving-arms, wherein an outer diameter of the inner tubular locker is reducing to form a ladder-shaped outer circumferential surface. The inner tubular locker defines a lower portion, a mid-portion, and an upper portion that the diameter of the lower portion is larger than the diameter of the mid-portion which is larger than the diameter of the upper portion. One or more mounting holes are spacedly formed at the lower portion of the inner tubular locker such that the rivets are coupled the inner tubular locker through the mounting holes with the lower curving-arm. The mid-portion of the inner tubular locker has an outer threaded portion. At least two opening grooves are axially formed at the upper portion of the inner tubular locker, wherein the upper portion of the inner tubular locker has a tapered shape that the diameter of the upper portion of the inner tubular locker is gradually reducing from bottom to top.

The outer tubular locker has a hollow cylindrical shape that a diameter of the outer tubular locker is gradually reducing from bottom to top. The outer tubular locker further has a lower portion and an inner threaded portion provided thereat to rotatably couple with the outer threaded portion of the mid-portion of the inner tubular locker, and an upper portion having an inner diameter gradually reducing from bottom to top. The upper portion of the outer tubular locker is engaged with the upper portion of the inner tubular locker such that the inner threaded portion of the outer tubular locker is rotatably engaged with the outer threaded portion of the inner tubular locker until the upper portion of the outer tubular locker is engaged with the upper portion of the inner tubular locker. A plurality of frictional ribs are axially protruded from an outer circumferential surface of the outer tubular locker.

The door and sliding track assembly further comprises a locker assembly provided on top of the door assembly and comprising a U-shaped locker panel coupled at an opening end of the door assembly. A lower panel portion of the locker panel has a lower locker slot while an upper panel portion of the locker panel has an upper locker slot aligning with the lower locker slot. The locker assembly further comprises a locker latch slidably extending from the upper locker slot to the lower locker slot, and an enlarged locker head provided at an upper end of the locker latch at a position above the upper panel portion of the locker panel. A resilient element is coaxially mounted around the locker latch, wherein two ends of the resilient element are biased against the upper and lower panel portions of the locker panel respectively. A gasket is coupled with the lower end of the resilient element and is coupled with the locker latch such that the gasket is pressed on the lower panel portion of the locker panel via a resilient force of the resilient element. A switch is operatively coupled with the door assembly, wherein the switch comprises a switch shaft horizontally extended through a through hole of the door assembly so as to extend within an interior of the supporting base. The switch shaft has a horizontal screw hole and a vertical screw hole, wherein the locker shaft is extended to engage with the vertical screw hole of the switch shaft. A locker axle is rotatably engaged with the horizontal screw hole of the switch shaft, wherein the locker axle is slidably couple with the locker shaft through the shaft hole of the switch shaft such that the locker shaft is movably coupled with the switch.

Compared to the previous technologies of the outdoor heaters, the present invention has the following advantage.

The eccentric telescopic portable outdoor heater of the present invention utilizes liquefied petroleum gas or natural gas as the fuel for generating heat energy so as to keep the user warm outdoors. The eccentric telescopic portable outdoor heater comprises a burner assembly, a supporting base, and a connecting assembly provided between the burner assembly and the supporting base. Having the eccentric and retractable abilities and the streamline appearance of the outdoor heater, the present invention enhances the portability of the outdoor heater for the user to use outdoors. The height adjustment of the burner assembly of the outdoor heater is simple by sliding the upper curving-arm along the lower curving-arm to selectively adjust the height-position of the burner assembly and to selectively adjust the heat-covering area of the heat generation portion of the burner assembly so as to adjust the heat radiation range thereof for heat distribution.

The supporting base comprises an easy fuel installation structure for receiving a fuel container, i.e. a gas bottle, in a cavity of the supporting base. The easy fuel installation structure comprises a gas bottle cover assembly enclosing a supporting assembly, and a door and sliding track assembly to form an enclosed cavity of the supporting base, wherein the fuel container can be replaceably held in the supporting base to operatively link with the burner assembly. Accordingly, the door and sliding track assembly comprises a door assembly, sliding trackers, and a wheel assembly, wherein the sliding trackers are able to support the fuel container at the supporting rack and the wheel assembly. Therefore, by opening or closing the door, the fuel container can be installed into or enclosed within the supporting base, so as to easily locate the fuel container while being time effective. In other words, the easy fuel installation structure solves the problem of the conventional outdoor heater which requires the fuel container being directly installed under the base.

These and other objectives, features, and advantages of the present invention will become apparent from the following detailed description, the accompanying drawings, and the appended claims.

DETAILED DESCRIPTION OF THE PREFERRED EMBODIMENT

Figure 1:
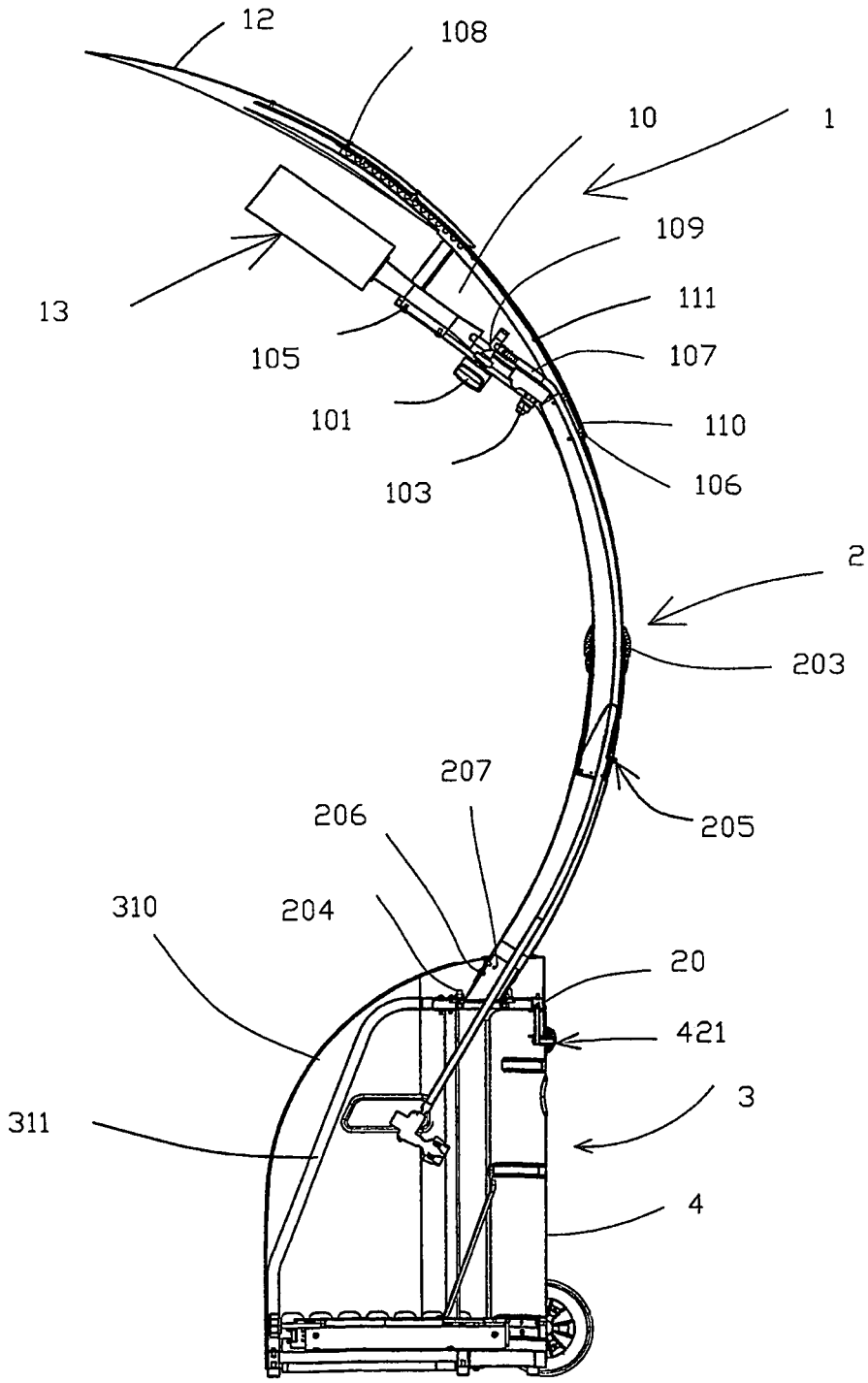
FIG. 1 is a perspective view of an eccentric telescopic portable outdoor heater according to a preferred embodiment of the present invention.
Figure 12:
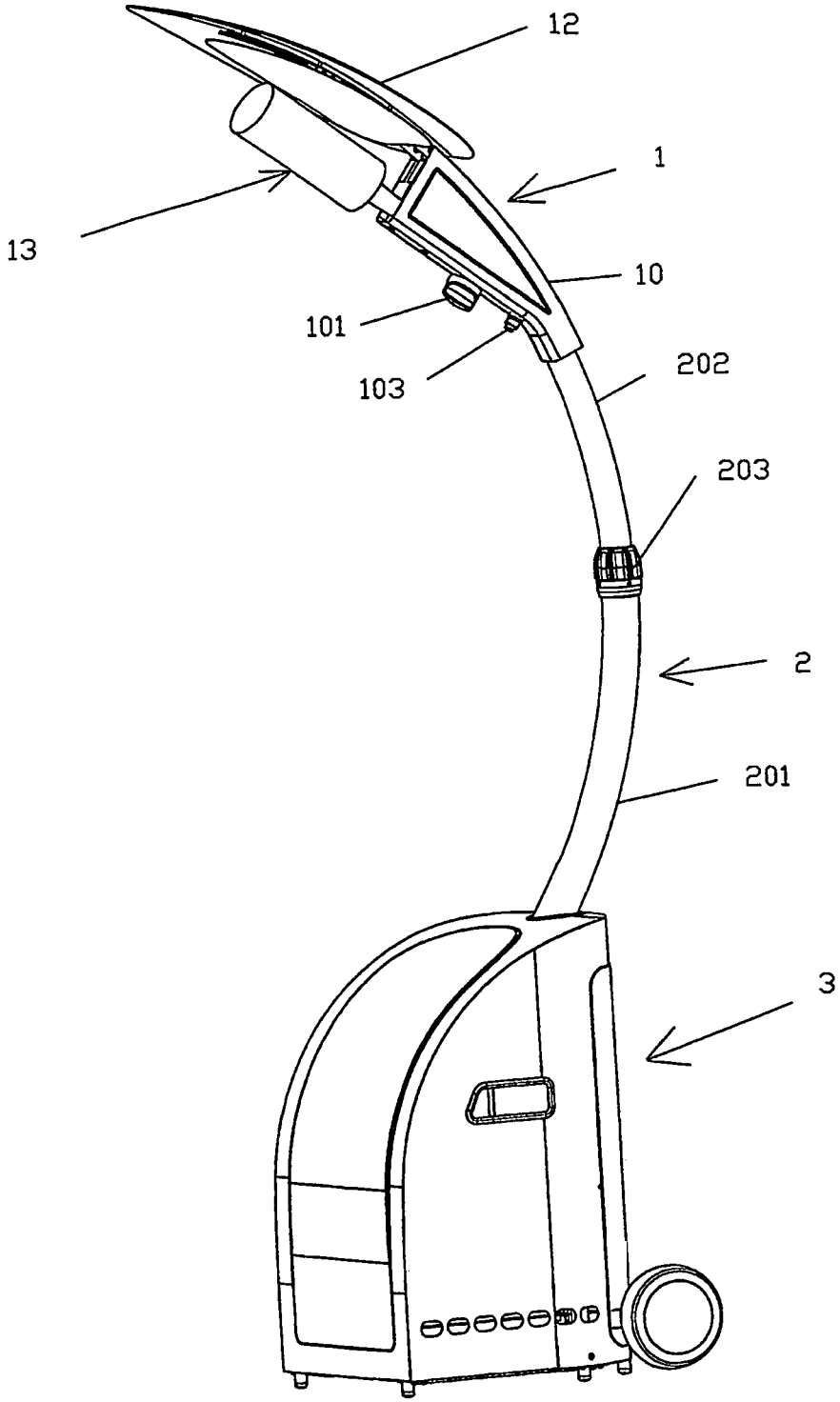
FIG. 12 is another perspective view of the eccentric telescopic portable outdoor heater according to the above preferred embodiment of the present invention.

Referring to FIGS. 1 and 12, an eccentric telescopic portable outdoor heater according a preferred embodiment is illustrated, which utilizes liquefied petroleum gas or natural gas as the fuel for generating heat energy so as to keep the user warm outdoors. The eccentric telescopic portable outdoor heater comprises a burner assembly 1, a supporting base 3, and a connecting assembly 2 provided between the burner assembly 1 and the supporting base 3. The connecting assembly 2 is an arched telescopic curving-arm assembly for the burner assembly 1 to selectively adjust a height of the burner assembly 1 with respect to the supporting base 3. The supporting base 3 further comprises an easy fuel installation structure for receiving a fuel container, i.e. a gas bottle, in a cavity of the supporting base 3 such that the fuel container can be replaceably held in the supporting base 3 to operatively link with the burner assembly 1. The supporting base 3, the connecting assembly 2, and the burner assembly 1 form an eccentric retractable and portable structure that the outdoor heater has a smooth arched configuration. Such arched configuration of the outdoor heater enhances the installation of the fuel container that the user is able to conveniently put in or take out the fuel container by sliding the fuel container into the cavity through the sliding track and opening the container cover. The height adjustment of the burner assembly 1 of the outdoor heater is simple by sliding the upper curving-arm along the lower curving-arm to selectively adjust the height-position of the burner assembly 1 and to selectively adjust the heat-covering area of the heat generation portion of the burner assembly 1 so as to adjust the heat radiation range thereof for heat distribution.

Figure 2:
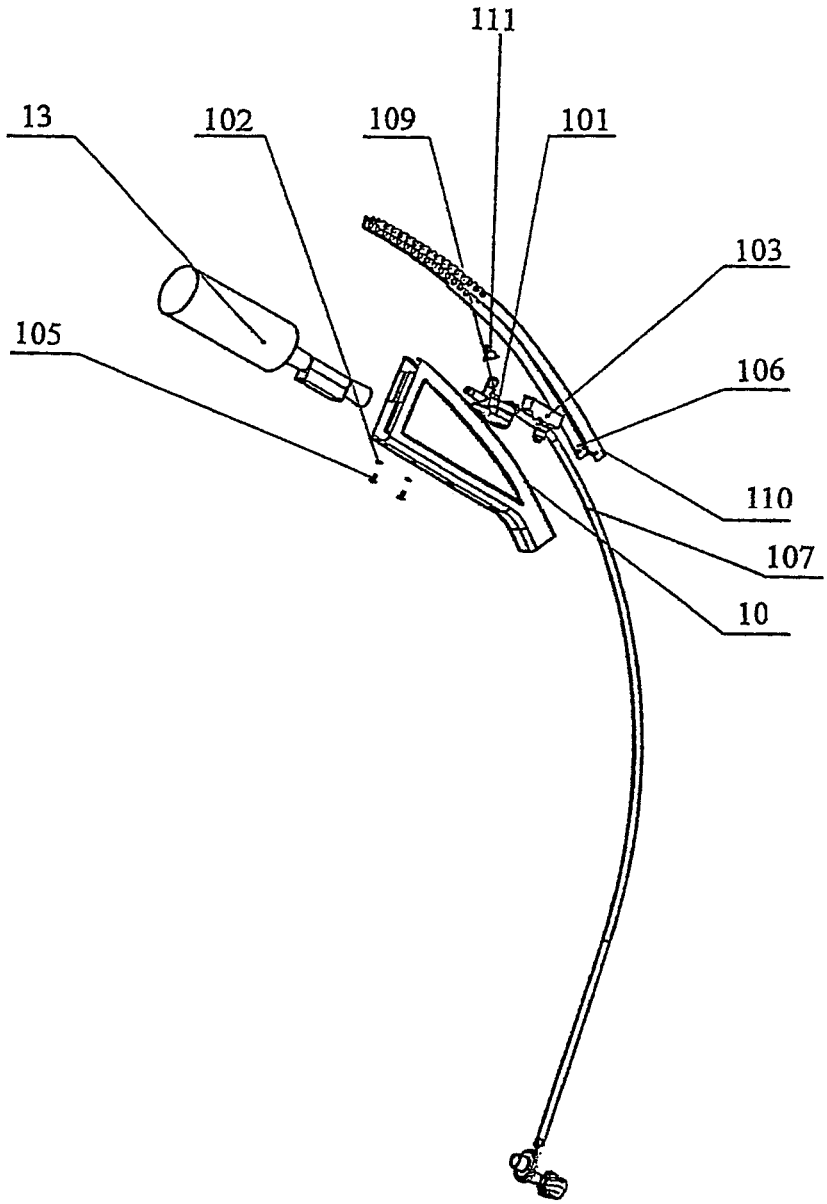
FIG. 2 is an exploded perspective view of a burner assembly of the eccentric telescopic portable outdoor heater according to the above preferred embodiment of the present invention, wherein the reflection in FIG. 1 is removed from the burner assembly.
Figure 9:
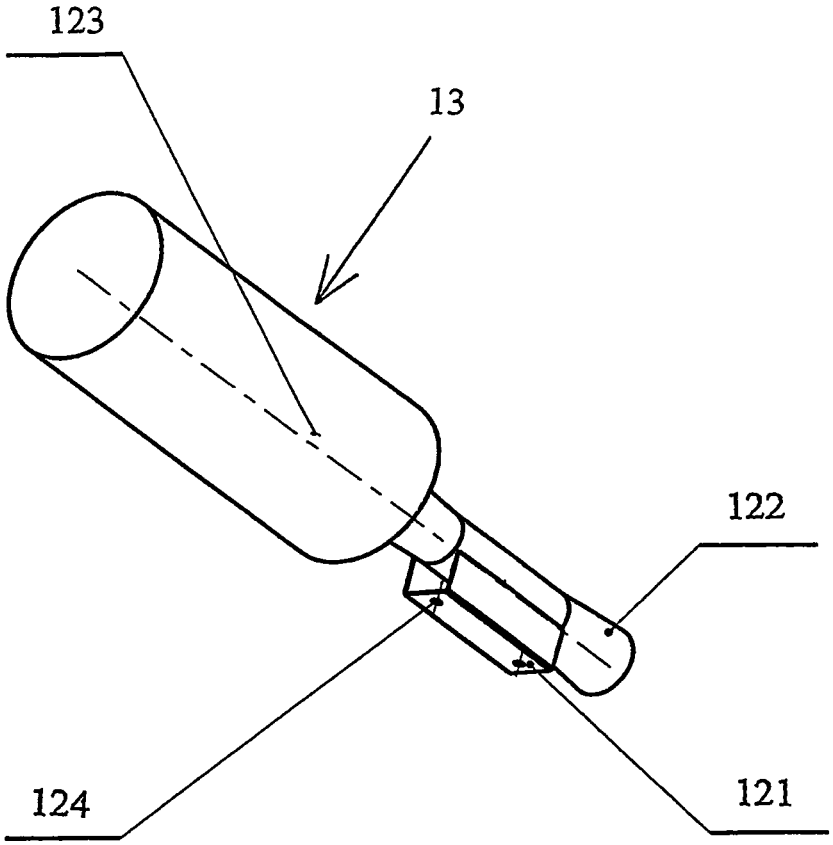
FIG. 9 is a perspective view of a burner of the eccentric telescopic portable outdoor heater according to the above preferred embodiment of the present invention.

Referring to FIG. 1, FIG. 12, and FIG. 2 of the drawing, the eccentric telescopic portable outdoor heater is illustrated, wherein the burner assembly 1 comprises an arc-shaped supporting arm 110 having a retractable and rotatable ability. The lower portion of the supporting arm 110 is coupled with an upper portion of the connecting assembly 2 via a screw 106 while the upper portion of the supporting arm 110 is coupled with a reflection casing 12 with a corresponding arc-shape via two screws 108, 109, and a supporter 10. In other words, the connection section between the reflection casing 12 with the supporter 10 and the supporting arm 110 has the arc shape correspondingly matching with the arc shape of the supporting arm 110. As shown FIG. 9, a burner 13 is coupled with the supporter 10 via a screw 105. Accordingly, the burner 13 comprises an infrared casing 123 and an injection tube 122 operatively coupling thereto. In addition, a burner supporter 121 is coupled with the injection tube 122 preferably by welding, wherein a screw hole 124 is formed at the burner supporter 121 to couple with the corresponding screw 105 at the supporter 10 such that the screw 105 is engaged with the screw hole 124 to couple the burner supporter 121 with the supporter 10. Furthermore, the supporter 10 has a screw hole (not shown in the figure) correspondingly matching with the screw hole 124 of the burner supporter 121. The burner supporter 121 further comprises a rotatable knob 101 provided at the lower portion thereof to operatively couple with a valve 109 of the burner 13, so as to operate the valve 109 in a controllable manner. The supporter 10 further comprises an igniter 103, a gas channel, and a pressure reducing valve assembly 107 respectively provided at the lower portion of the supporter 10. The gas channel and the pressure reducing valve assembly 107 are respectively extended through the connecting assembly 2 to the supporting base 3 so as to operatively connect to the fuel container. Accordingly, the fuel container is disposed in the supporting base 3 (not shown in figure).

Figure 5:
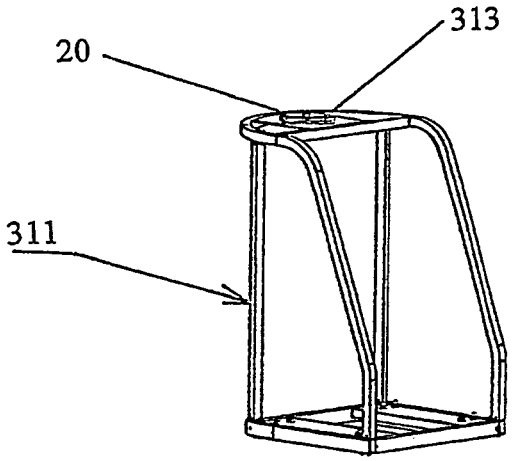
FIG. 5 is a perspective view of a supporting assembly of the eccentric telescopic portable outdoor heater according to the above preferred embodiment of the present invention.
Figure 6:
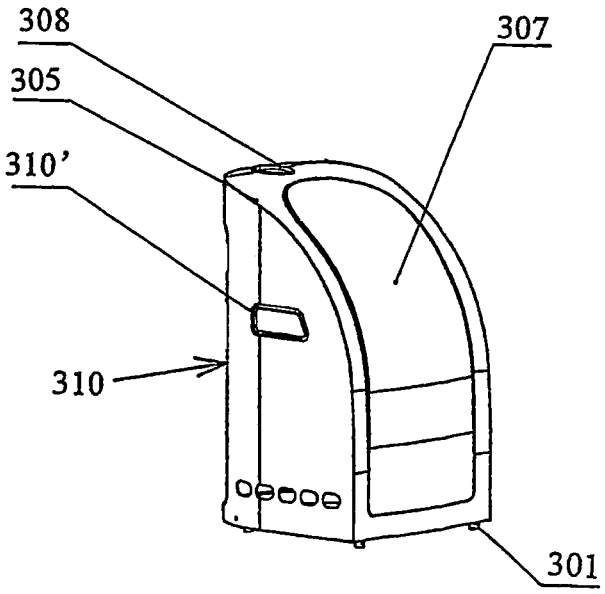
FIG. 6 is a perspective view of a gas bottle cover assembly of the eccentric telescopic portable outdoor heater according to the above preferred embodiment of the present invention.
Figure 7:
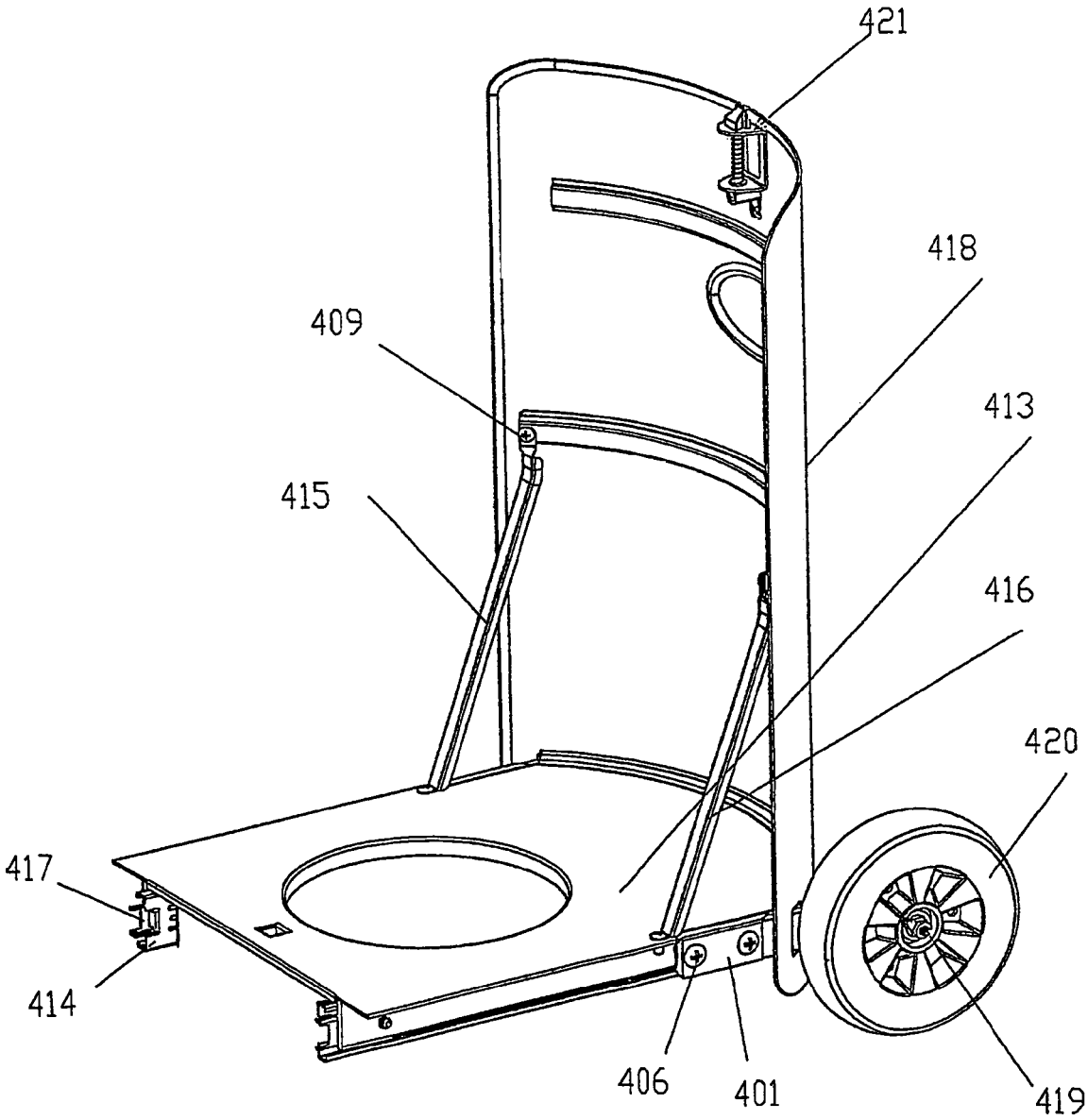
FIG. 7 is a perspective view of a door and sliding track assembly of the eccentric telescopic portable outdoor heater according to the above preferred embodiment of the present invention.
Figure 8:
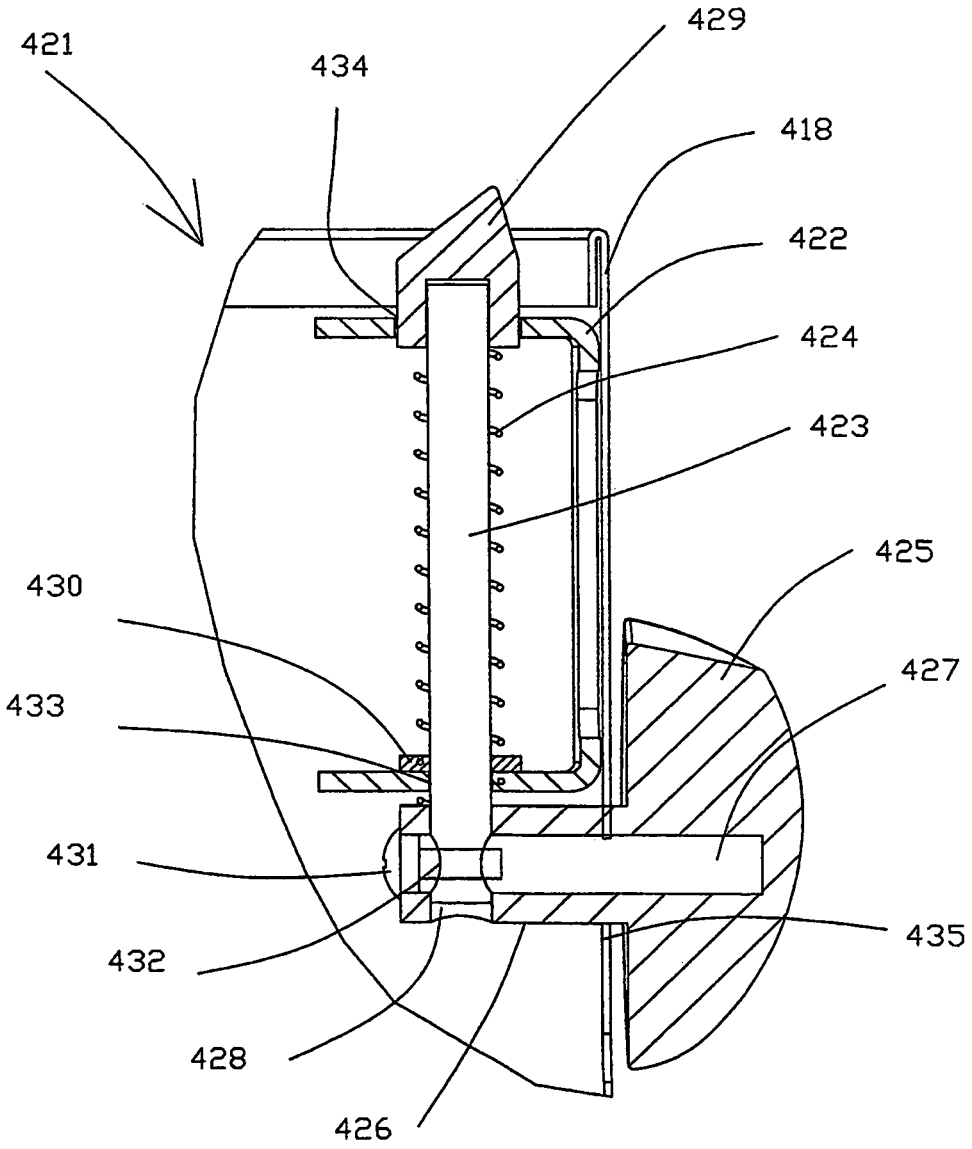
FIG. 8 is a sectional view of a locker assembly of the eccentric telescopic portable outdoor heater according to the above preferred embodiment of the present invention.

As shown in FIG. 1, FIG. 12, FIG. 5, FIG. 6 and FIG. 7, the supporting base 3 of the eccentric telescopic portable outdoor heater has a simple assembling structure for the fuel container being installed or removed conveniently. The supporting base 3 comprises a supporting assembly 311 and a gas bottle cover assembly 310 enclosed therewith, wherein the gas bottle cover assembly 310 is shaped and sized corresponding to the shape and size of the supporting assembly 311 to fit the supporting assembly 311 in the gas bottle cover assembly 310. The supporting base 3 further comprises a door and sliding track assembly 4 coupled between the gas bottle cover assembly 310 and the supporting assembly 311. As shown in FIG. 12, the supporting base 3 has an enclosed cavity for the fuel container receiving therein. As shown in FIG. 5, a guiding groove 20 is provided at the upper portion of the supporting assembly 311 and is coupled with a supporting panel 313 preferably by welding. It is worth to mention that the shape of the guiding groove 20 does not shown in FIG. 5, however, the configuration of the guiding groove 20 is shown in FIG. 1. Accordingly, after the door and sliding track assembly 4 are slid into the gas bottle cover assembly 310 to the supporting assembly 311, a locker assembly 421 of the supporting base 3 is releasably engaged with the guiding groove 20 so as to detachably couple the door and sliding track assembly 4 with the supporting assembly 311. As shown in FIG. 6, the gas bottle cover assembly 310 of the supporting base 3 further comprises a casing body 310', an enclosure 307 detachably coupling with the casing body 310' via a screw 305, a lower arm protection ring 308 provided at the upper portion of the casing body 310', and four standing legs 301 provided at the bottom side of the casing body 310' at the corners thereof respectively. As shown in FIG. 7, the door and sliding track assembly 4 of the supporting base 3 comprises a supporting rack 413, two sliding trackers 417 spacedly provided at the outer edge of the supporting rack 413, and two supporter plates 414 coupling with the sliding trackers 417 respectively. Accordingly, the inner edge of the supporting rack 413, i.e. the side of the supporting base 3, has a curved shape, wherein two wheel supporting panels 401 are respectively coupled with two side edges of the supporting rack 413 via the screws 406. Two wheel shafts 419 are extended from the wheel supporting panels 401, wherein two wheel assemblies 420 are operatively coupled at the wheel shafts 419 respectively. A door assembly 418 is coupled at the inner curved edge of the supporting rack 413 via screws (not shown). A left pulling arm 415 and a right pulling arm 416 are respectively extended from the left and right sides of the door assembly 418 to the supporting rack 413. In other words, each of the pulling arms 415, 416 has two ends coupling with the door assembly 418 and the supporting rack 413 via two screws 409. Accordingly, the locker assembly 421 is provided on top of the door assembly 418. As shown in FIG. 8, the locker assembly 421 comprises a U-shaped locker panel 422 coupled at the opening end of the door assembly 418, wherein a lower panel portion of the locker panel 422 has a lower locker slot 433 while an upper panel portion of the locker panel 422 has an upper locker slot 434 aligning with the lower locker slot 433. The locker assembly 421 further comprises a locker latch 423 slidably extending from the upper locker slot 434 to the lower locker slot 433, and an enlarged locker head 429 provided at an upper end of the locker latch 423 at a position above the upper panel portion of the locker panel 422. Accordingly, the shape of upper portion of the locker head 429 matches with the shape of the guiding groove 20 of the supporting assembly 311. A resilient element 424, preferably a compression spring, is coaxially mounted around the locker latch 423, wherein two ends of the resilient element 424 are biased against the upper and lower panel portions of the locker panel 422 respectively. A gasket 430 is coupled with the lower end of the resilient element 424 and is coupled with the locker latch 423 such that the gasket 430 is pressed on the lower panel portion of the locker panel 422 via the resilient force of the resilient element 424. A switch 425 is operatively coupled with the door assembly 418, wherein the switch 425 comprises a switch shaft 426 horizontally extended through a through hole 435 of the door assembly 418 so as to extend within the interior of the supporting base 3. The switch shaft 426 has a horizontal screw hole 427 and a vertical screw hole 428. The locker shaft 423 is extended to engage with the vertical screw hole 428 of the switch shaft 426. A locker axle 431 is rotatably engaged with the horizontal screw hole 427 of the switch shaft 426, wherein the locker axle 431 is slidably couple with the locker shaft 423 through the shaft hole 432 of the switch shaft 426 such that the locker shaft 423 is movably coupled with the switch 425. After the door and sliding track assembly 4 is slidably engaged with the gas bottle cover assembly 310 and the supporting assembly 311 to form the enclosed cavity of the supporting base 3, the locker head 429 is forced to be pressed downwardly by the supporting assembly 311. Accordingly, the resilient element 424 is pressed to move downwardly such that the resilient force of the resilient element 424 will push the locker latch 423 and the switch 425 downwardly. Once the locker head 429 is slidably engaged with the guiding groove 20 at the supporting assembly 311, the compressed resilient element 424 is bounded to its original form to retain the door and sliding track assembly 4 in position. In order to slidably pull out the door and sliding track assembly 4 and the supporting assembly 311, the switch 425 can be pressed downwardly and pulled outwardly. Therefore, the locker head 429 and the locker latch 423 are correspondingly actuated to move downwardly through the locker axle 431. At the same time, the locker head 429 will disengage with the guiding groove 20 at the supporting assembly 311 such that the door and sliding track assembly 4 can be pulled out for replacing or installing the fuel container.

Figure 4:
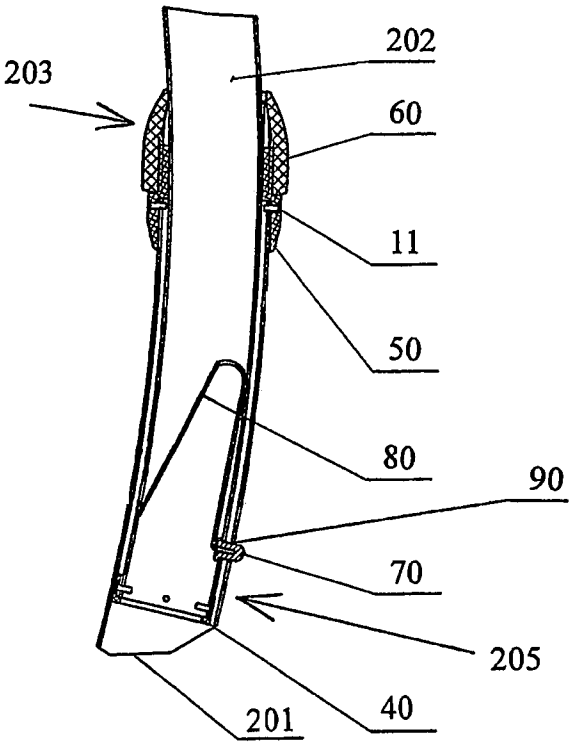
FIG. 4 is an enlarged sectional view of an arched telescopic curving-arm structure of the eccentric telescopic portable outdoor heater according to the above preferred embodiment of the present invention.
Figure 3:
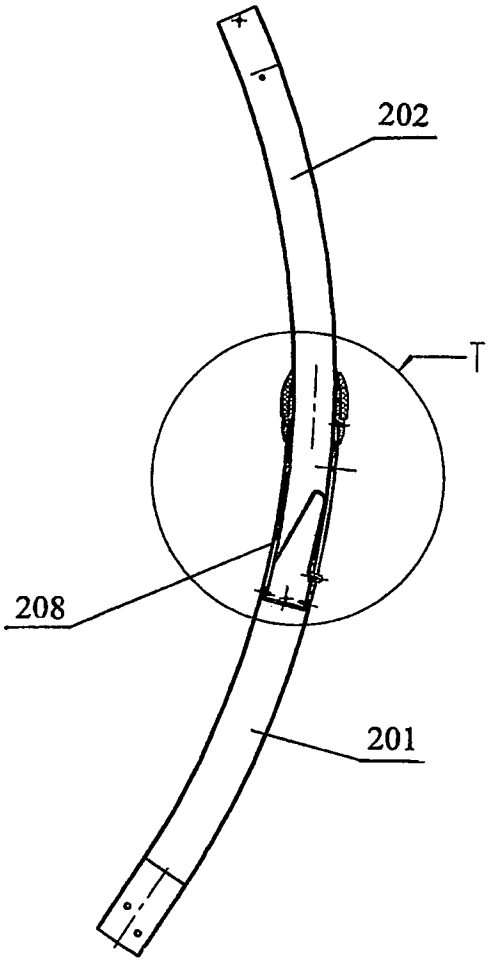
FIG. 3 is a sectional view of an arched telescopic curving-arm structure of the eccentric telescopic portable outdoor heater according to the above preferred embodiment of the present invention.
Figure 10:
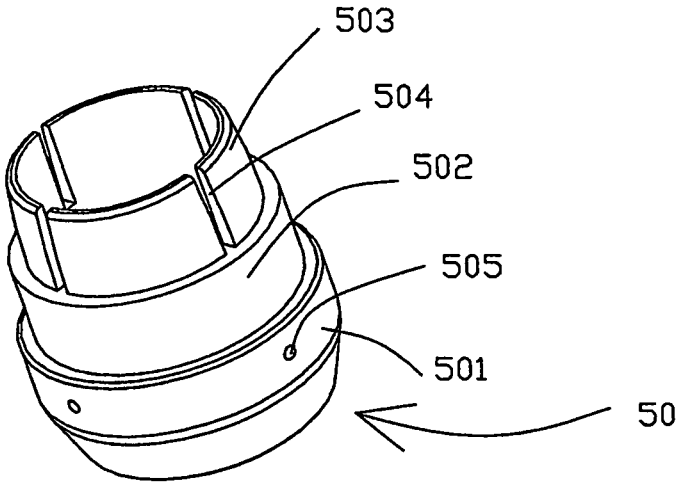
FIG. 10 is a perspective view of an inner tubular locker of the eccentric telescopic portable outdoor heater according to the above preferred embodiment of the present invention.
Figure 11:
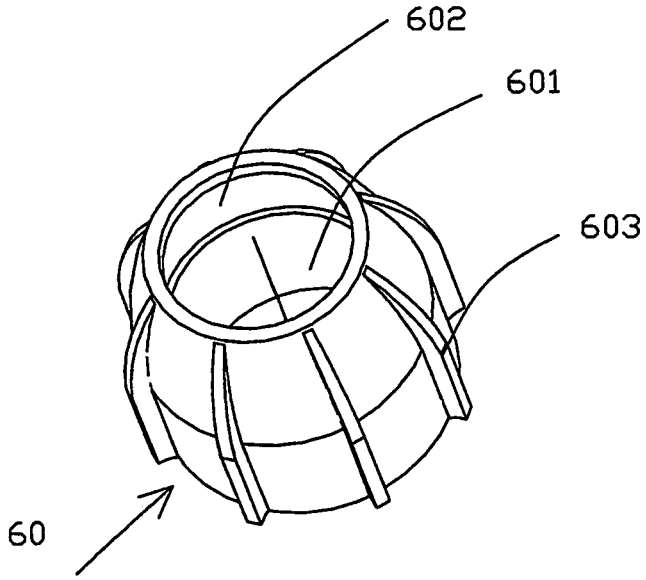
FIG. 11 is a perspective view of an outer tubular locker of the eccentric telescopic portable outdoor heater according to the above preferred embodiment of the present invention.

As shown in FIG. 1, FIG. 3, FIG. 4, FIG. 10, and FIG. 11, the connecting assembly 2 has an arc shaped configuration to retractably control the height of the burner assembly 1. The connecting assembly 2 comprises a tubular lower curving-arm 201 having an arc-shape, a tubular upper curving-arm 202 having an arc-shape slidably coupling with the lower arm 201, a lock device 203 provided between the lower and upper curving-arms 201, 202 for locking the lower and upper curving-arms 201, 202 in position, and a locating device 205. A tubular connector 207 is coupled at the lower portion of the lower curving-arm 201 via a screw 206, wherein the lower portion of the tubular connector 207 is coupled with the supporting panel 313 of the supporting assembly 311 of the supporting base 3 via a screw 204, as shown in FIG. 1. FIG. 3 illustrates the sliding connection between the lower and upper curving-arms 201, 202 that the lower curving-arm 201 is slidably inserted into the upper curving-arm 202. FIG. 4 is an enlarged sectional view to show the sliding connection between the lower and upper curving-arms 201, 202. The lock device 203 comprises an inner tubular locker 50 affixed to an upper portion of the lower curving-arm 201 via rivets 11, and an outer tubular locker 60 rotatably coupling with the inner tubular locker 50. As shown in FIG. 10, the inner tubular locker 50 has a hollow cylindrical shape, wherein an inner diameter of the inner tubular locker 50 matches with an outer diameter of each of the lower and upper curving-arms 201, 202. In addition, an outer diameter of the inner tubular locker 50 is reducing from the lower portion to the upper portion to form a ladder-shaped outer circumferential surface. Accordingly, the inner tubular locker 50 defines a lower portion 501, a mid-portion 502, and an upper portion 503 that the diameter of the lower portion 501 is larger than the diameter of the mid-portion 502 which is larger than the diameter of the upper portion 503. One or more mounting holes 505 are spacedly formed at the lower portion 501 of the inner tubular locker 50, wherein the rivets 11 are coupled the inner tubular locker 50 through the mounting holes 505 with the lower curving-arm 201. The mid-portion 502 of the inner tubular locker 50 has an outer threaded portion. At least two opening grooves 504 are axially formed at the upper portion 503 of the inner tubular locker 50. Preferably, there are four opening grooves 504 spacedly formed at the upper portion 503 of the inner tubular locker 50, wherein the upper portion 503 of the inner tubular locker 50 has a tapered shape that the diameter of the upper portion 503 of the inner tubular locker 50 is gradually reducing from bottom to top. As shown in FIG. 11, the outer tubular locker 60 has a hollow cylindrical shape, wherein the diameter of the outer tubular locker 60 is gradually reducing from bottom to top. The outer tubular locker 60 further has a lower portion 601 and an inner threaded portion provided thereat to rotatably couple with the outer threaded portion of the mid-portion 502 of the inner tubular locker 50. An upper portion 602 of the outer tubular locker 60 has an inner diameter gradually reducing from bottom to top, wherein the upper portion 602 of the outer tubular locker 60 is engaged with the upper portion 503 of the inner tubular locker 50. In other words, the inner threaded portion of the outer tubular locker 60 is rotatably engaged with the outer threaded portion of the inner tubular locker 50 until the upper portion 602 of the outer tubular locker 60 is engaged with the upper portion 503 of the inner tubular locker 50. A plurality of frictional ribs 603 are axially protruded from the outer circumferential surface of the outer tubular locker 60 for the user to turn the outer tubular locker 60 to lock up with the inner tubular locker 50.

As shown in FIG. 4, the locating device 205 is provided between the lower and upper curving-arms 201, 202, wherein the locating device 205 comprises a head stopper 40 provided at the lower end of the upper curving-arm 202. The locating device 205 further comprises a retainer 70 having a through slot formed thereon, and a flexible element 80. The retainer 70 is extended through retention holes 90 of the lower and upper curving-arms 201, 202. The flexible element 80 is supported within the upper curving-arm 202, wherein one end of the flexible element 80 is affixed to the through slot of the retainer 70 while another opposed end of the flexible element 80 as a free end thereof is biased against an inner wall of the upper curving-arm 202. Accordingly, the retainer 70 is slidably extended through the retention holes 90 of the lower and upper curving-arms 201, 202 to prevent the lower and upper curving-arms 201, 202 from being detached during the sliding movement. The flexible element 80 is a V-shaped spring clip. When the burner assembly 1 is selectively adjusted its height, the heat-covering area of the heat generation portion of the burner assembly 1 will be correspondingly adjusted to adjust the heat radiation range thereof for heat distribution. Accordingly, by rotatably loosing the outer tubular locker 60 with respect to the inner tubular locker 50, the upper curving-arm 202 can be freely slid at the lower curving-arm 201 such that the upper curving-arm 202 can be either slid up or down with respect to the lower curving-arm 201. By the elastic force of the flexible element 80, the free end of the flexible element 80 is slidably biased against the inner wall of the upper curving-arm 202. The retainer 70 has a smooth curving end adapted to disengage with the respective through hole and to slide at the inner wall of the lower curving-arm 201, so as to enable the sliding movement between the lower and upper curving-arms 201, 202. Once the height of the burner assembly 1 is adjustably set, the outer tubular locker 60 can be rotatably re-tightened with the inner tubular locker 50 to lock up the relative extendable position between the lower and upper curving-arms 201, 202.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An eccentric telescopic portable outdoor heater, comprising: a burner assembly 1, a supporting base 3, and a connecting assembly 2 coupling between said burner assembly 1 and said supporting base 3, wherein said connecting assembly 2 comprises an arc-shaped retractable configuration for said burner assembly 1 to selectively adjust a height of said burner assembly 2 with respect to said supporting base 3, wherein said supporting base 3 comprises an easy fuel installation structure for receiving a fuel container in a cavity of said supporting base 3, wherein said supporting base 3, said connecting assembly 2, and said burner assembly 1 form an eccentric retractable and portable structure that said outdoor heater has an arc-shaped configuration, wherein said burner assembly 1 comprises an arc-shaped supporting arm 110 having a retractable ability, wherein a lower portion of said supporting arm 110 is coupled with an upper portion of said connecting assembly 2 via a screw 106 while an upper portion of the supporting arm 110 is coupled with a reflection casing 12 with a corresponding arc-shape via two screws 108, 111, and a supporter 10, wherein a burner 13 is coupled with said supporter 10 via a screw 105, wherein said supporter 10 further comprises a rotatable knob 101 provided at said lower portion thereof to operatively couple with a valve 109 of said burner 13, so as to operate said valve 109 in a controllable manner, wherein said supporter 10 further comprises an igniter 103, a gas channel, and a pressure reducing valve assembly 107 respectively provided at said lower portion of said supporter 10, wherein said gas channel and said pressure reducing valve assembly are respectively extended through said connecting assembly 2 to said supporting base 3 for operatively connecting to said fuel container.

2. The eccentric telescopic portable outdoor heater, as in claim 1, wherein said burner comprises an infrared casing 123 and an injection tube 122 operatively coupling thereto, wherein a burner supporter 121 is coupled with said injection tube 122, wherein a screw hole 124 is formed at said burner supporter 121 to couple with said corresponding screw 105 at said supporter 10 such that said screw 105 is engaged with said screw hole 124 to couple said burner supporter 121 with said supporter 10.

3. An eccentric telescopic portable outdoor heater, comprising: a burner assembly 1, a supporting base 3, and a connecting assembly 2 coupling between said burner assembly 1 and said supporting base 3, wherein said connecting assembly 2 comprises an arc-shaped retractable configuration for said burner assembly 1 to selectively adjust a height of said burner assembly 2 with respect to said supporting base 3, wherein said supporting base 3 comprises an easy fuel installation structure for receiving a fuel container in a cavity of said supporting base 3, wherein said supporting base 3, said connecting assembly 2, and said burner assembly 1 form an eccentric retractable and portable structure that said outdoor heater has an arc-shaped configuration, wherein said supporting base 3 comprises a supporting assembly 311 and a gas bottle cover assembly 310 having a shape and size corresponding to said supporting assembly 311 for said supporting assembly 311 enclosing within said gas bottle cover assembly 310, wherein said supporting base 3 further comprises a door and sliding track assembly 4 coupled between said gas bottle cover assembly 310 and said supporting assembly 311 to form an enclosed structure of said supporting base 3, wherein a guiding groove 20 is provided at said upper portion of said supporting assembly 311 and is coupled with a supporting panel 313.

4. An eccentric telescopic portable outdoor heater, comprising: a burner assembly 1, a supporting base 3, and a connecting assembly 2 coupling between said burner assembly 1 and said supporting base 3, wherein said connecting assembly 2 comprises an arc-shaped retractable configuration for said burner assembly 1 to selectively adjust a height of said burner assembly 2 with respect to said supporting base 3, wherein said supporting base 3 comprises an easy fuel installation structure for receiving a fuel container in a cavity of said supporting base 3, wherein said supporting base 3, said connecting assembly 2, and said burner assembly 1 form an eccentric retractable and portable structure that said outdoor heater has an arc-shaped configuration, wherein said supporting base 3 comprises a supporting assembly 311 and a gas bottle cover assembly 310 having a shape and size corresponding to said supporting assembly 311 for said supporting assembly 311 enclosing within said gas bottle cover assembly 310, wherein said supporting base 3 further comprises a door and sliding track assembly 4 coupled between said gas bottle cover assembly 310 and said supporting assembly 311 to form an enclosed structure of said supporting base 3, wherein said gas bottle cover assembly 310 of said supporting base 3 further comprises a casing body 310', an enclosure 307 detachably coupling with said casing body 310' via a screw 305, a lower arm protection ring 308 provided at an upper portion of said casing body 310', and four standing legs 301 provided at a bottom side of said casing body 310' at corners thereof respectively.

5. An eccentric telescopic portable outdoor heater, comprising: a burner assembly 1, a supporting base 3, and a connecting assembly 2 coupling between said burner assembly 1 and said supporting base 3, wherein said connecting assembly 2 comprises an arc-shaped retractable configuration for said burner assembly 1 to selectively adjust a height of said burner assembly 2 with respect to said supporting base 3, wherein said supporting base 3 comprises an easy fuel installation structure for receiving a fuel container in a cavity of said supporting base 3, wherein said supporting base 3, said connecting assembly 2, and said burner assembly 1 form an eccentric retractable and portable structure that said outdoor heater has an arc-shaped configuration, wherein said supporting base 3 comprises a supporting assembly 311 and a gas bottle cover assembly 310 having a shape and size corresponding to said supporting assembly 311 for said supporting assembly 311 enclosing within said gas bottle cover assembly 310, wherein said supporting base 3 further comprises a door and sliding track assembly 4 coupled between said gas bottle cover assembly 310 and said supporting assembly 311 to form an enclosed structure of said supporting base 3, wherein said door and sliding track assembly 4 of said supporting base 3 comprises a supporting rack 413, two sliding trackers 417 spacedly provided at an outer edge of said supporting rack 413, and two supporter plates 414 coupling with said sliding trackers 417 respectively, wherein an inner edge of said supporting rack 413 has a curved shape, wherein two wheel supporting panels 401 are respectively coupled with two side edges of said supporting rack 413 via screws 406, wherein two wheel shafts 419 are extended from said wheel supporting panels 401, wherein two wheel assemblies 420 are operatively coupled at said wheel shafts 419 respectively, wherein a door assembly 418 is coupled at said inner curved edge of said supporting rack 413, wherein a left pulling arm 415 and a right pulling arm 416 are respectively extended from left and right sides of said door assembly 418 to said supporting rack 413 such that each of said pulling arms 415, 416 has two ends coupling with said door assembly 418 and said supporting rack 413 via two screws 409.

6. The eccentric telescopic portable outdoor heater, as recited in claim 5, wherein said door and sliding track assembly 4 further comprises a locker assembly 421 provided on top of said door assembly 418 and comprising a U-shaped locker panel 422 coupled at an opening end of said door assembly 418, wherein a lower panel portion of said locker panel 422 has a lower locker slot 433 while an upper panel portion of said locker panel 422 has an upper locker slot 434 aligning with said lower locker slot 433, wherein said locker assembly 421 further comprises a locker latch 423 slidably extending from said upper locker slot 434 to said lower locker slot 433, and an enlarged locker head 429 provided at an upper end of said locker latch 423 at a position above said upper panel portion of said locker panel 422, wherein a resilient element 424 is coaxially mounted around said locker latch 423, wherein two ends of said resilient element 424 are biased against said upper and lower panel portions of said locker panel 422 respectively, wherein a gasket 430 is coupled with said lower end of said resilient element 424 and is coupled with said locker latch 423 such that said gasket 430 is pressed on said lower panel portion of said locker panel 422 via a resilient force of said resilient element 424, wherein a switch 425 is operatively coupled with said door assembly 418, wherein said switch 425 comprises a switch shaft 426 horizontally extended through a through hole 435 of said door assembly 418 so as to extend within an interior of said supporting base 3, wherein said switch shaft 426 has a horizontal screw hole 427 and a vertical screw hole 428, wherein said locker shaft 423 is extended to engage with said vertical screw hole 428 of said switch shaft 426, wherein a locker axle 431 is rotatably engaged with said horizontal screw hole 427 of said switch shaft 426, wherein said locker axle 431 is slidably couple with said locker shaft 423 through said shaft hole 432 of said switch shaft 426 such that said locker shaft 423 is movably coupled with said switch 425.

7. An eccentric telescopic portable outdoor heater, comprising: a burner assembly 1 a supporting base 3 and a connecting assembly 2 coupling between said burner assembly 1 and said supporting base 3, wherein said connecting assembly 2 comprises an arc-shaped retractable configuration for said burner assembly 1 to selectively adjust a height of said burner assembly 2 with respect to said supporting base 3, wherein said supporting base 3 comprises an easy fuel installation structure for receiving a fuel container in a cavity of said supporting base 3, wherein said supporting base 3, said connecting assembly 2, and said burner assembly 1 form an eccentric retractable and portable structure that said outdoor heater has an arc-shaped configuration, wherein said connecting assembly 2 comprises a tubular lower curving-arm 201 having an arc-shape, a tubular upper curving-arm 202 having an arc-shape slidably coupling with said lower arm 201, a lock device 203 provided between said lower and upper curving-arms 201, 202 for locking said lower and upper curving-arms 201, 202 in position, and a locating device 205, wherein a tubular connector 207 is coupled at a lower portion of said curving-arm 201 via a screw 206, wherein a lower portion of said tubular connector 207 is coupled with said supporting panel 313 of said supporting assembly 311 of said supporting base 3 via a screw 204.

8. The eccentric telescopic portable outdoor heater, as recited in claim 7, wherein said lock device 203 comprises an inner tubular locker 50 affixed to an upper portion of said lower curving-arm 201 via rivets 11, and an outer tubular locker 60 rotatably coupling with said inner tubular locker 50.

9. The eccentric telescopic portable outdoor heater, as recited in claim 7, wherein said locating device 205 is provided between said lower and upper curving-arms 201, 202, wherein said locating device 205 comprises a head stopper 40 provided at a lower end of said upper curving-arm 202, wherein said locating device 205 further comprises a retainer 70 having a through slot formed thereon, and a flexible element 80, wherein said retainer 70 is extended through retention holes 90 of said lower and upper curving-arms 201, 202, wherein said flexible element 80 is supported within said upper curving-arm 202, wherein one end of said flexible element 80 is affixed to said through slot of said retainer 70 while another opposed end of said flexible element 80 as a free end thereof is biased against an inner wall of said upper curving-arm 202.

10. The eccentric telescopic portable outdoor heater, as recited in claim 8, wherein said tubular locker 50 has a hollow cylindrical shape and has an inner diameter matching with an outer diameter of each of said lower and upper curving-arms 201, 202, wherein an outer diameter of said inner tubular locker 50 is reducing to form a ladder-shaped outer circumferential surface, wherein said inner tubular locker 50 defines a lower portion 501, a mid-portion 502, and an upper portion 503 that the diameter of said lower portion 501 is larger than the diameter of said mid-portion 502 which is larger than the diameter of said upper portion 503, wherein one or more mounting holes 505 are spacedly formed at said lower portion 501 of said inner tubular locker 50 such that said rivets 11 are coupled said inner tubular locker 50 through said mounting holes 505 with said lower curving-arm 201, wherein said mid-portion 502 of said inner tubular locker 50 has an outer threaded portion, wherein at least two opening grooves 504 are axially formed at said upper portion 503 of said inner tubular locker 50, wherein said upper portion 503 of said inner tubular locker 50 has a tapered shape that the diameter of said upper portion 503 of said inner tubular locker 50 is gradually reducing from bottom to top.

11. The eccentric telescopic portable outdoor heater, as recited in claim 8, wherein said outer tubular locker 60 has a hollow cylindrical shape that a diameter of said outer tubular locker 60 is gradually reducing from bottom to top, wherein said outer tubular locker 60 further has a lower portion 601 and an inner threaded portion provided thereat to rotatably couple with said outer threaded portion of said mid-portion 502 of said inner tubular locker 50, and an upper portion 602 having an inner diameter gradually reducing from bottom to top, wherein said upper portion 602 of said outer tubular locker 60 is engaged with said upper portion 503 of said inner tubular locker 50 such that said inner threaded portion of said outer tubular locker 60 is rotatably engaged with said outer threaded portion of said inner tubular locker 50 until said upper portion 602 of said outer tubular locker 60 is engaged with said upper portion 503 of said inner tubular locker 50, wherein a plurality of frictional ribs 603 are axially protruded from an outer circumferential surface of said outer tubular locker 60.

* * * * *